US008590646B2

(12) United States Patent
Lambert et al.

(10) Patent No.: US 8,590,646 B2
(45) Date of Patent: Nov. 26, 2013

(54) IMPREGNATED CUTTING ELEMENTS WITH LARGE ABRASIVE CUTTING MEDIA AND METHODS OF MAKING AND USING THE SAME

(75) Inventors: Christian M. Lambert, Draper, UT (US); Michael D. Rupp, Murray, UT (US)

(73) Assignee: Longyear TM, Inc., South Jordan, UT (US)

( * ) Notice: Subject to any disclaimer, the term of this patent is extended or adjusted under 35 U.S.C. 154(b) by 118 days.

(21) Appl. No.: 12/885,284

(22) Filed: Sep. 17, 2010

(65) Prior Publication Data

US 2011/0067924 A1 Mar. 24, 2011

Related U.S. Application Data

(60) Provisional application No. 61/244,806, filed on Sep. 22, 2009.

(51) Int. Cl.
*E21B 10/02* (2006.01)
*E21B 10/48* (2006.01)

(52) U.S. Cl.
USPC ..... 175/434; 175/425

(58) Field of Classification Search
USPC ..... 175/425, 434; 51/307, 295
See application file for complete search history.

(56) References Cited

U.S. PATENT DOCUMENTS 367,956 A 8/1887 Brewer
1,041,568 A 10/1912 Bade
1,572,386 A 2/1926 Gates
1,939,991 A 12/1933 Krusell
2,147,843 A 2/1939 Jamar et al.
2,326,908 A 8/1943 Williams, Jr.
2,371,488 A 3/1945 Williams, Jr.
2,495,400 A 1/1950 Williams, Jr.
2,552,485 A 5/1951 Howard et al.
2,811,960 A 11/1957 Fessel
2,966,949 A 1/1961 Wepsala, Jr.
2,969,122 A 1/1961 Steffes
3,215,215 A 11/1965 Kellner (Continued)

FOREIGN PATENT DOCUMENTS

CN 201326379 10/2009
CN 101713280 A * 5/2010

(Continued)

OTHER PUBLICATIONS

Office Action dated Nov. 14, 2011 from U.S. Appl. No. 12/276,903, filed Nov. 24, 2008 (9 pages).

(Continued)

*Primary Examiner* — Daniel P Stephenson
(74) *Attorney, Agent, or Firm* — Ballard Spahr LLP

(57) ABSTRACT

Implementations of the present invention include impregnated drill bits having a plurality of relatively large abrasive cutting media, such as polycrystalline diamonds, embedded therein. According to some implementations of the present invention, the relatively large abrasive cutting media can be dispersed in an unorganized arrangement throughout at least a portion of the crown. Additionally, one or more implementations can include a second plurality of relatively small abrasive cutting media. Implementations of the present invention also include drilling systems including impregnated drill bits having a plurality of relatively large abrasive cutting media embedded therein, methods of using such impregnated drill bits, and methods of forming such impregnated drill bits.

33 Claims, 7 Drawing Sheets

(56) References Cited

U.S. PATENT DOCUMENTS

| | | | | |
|---|---|---|---|---|
| RE26,669 | E | 9/1969 | Henderson | |
| 3,495,359 | A | 2/1970 | Smith et al. | |
| 3,537,538 | A | 11/1970 | Generoux | |
| 3,972,161 | A | 8/1976 | Zoiss | |
| 4,128,136 | A | 12/1978 | Generoux | |
| 4,186,628 | A | 2/1980 | Bonnice | |
| 4,189,015 | A | 2/1980 | Acker et al. | |
| 4,190,126 | A | 2/1980 | Kabashima | |
| 4,208,154 | A | 6/1980 | Gundy | |
| 4,211,294 | A | 7/1980 | Multakh | |
| 4,452,325 | A | 6/1984 | Radd et al. | |
| 4,499,959 | A | 2/1985 | Grappendorf et al. | |
| 4,505,746 | A | 3/1985 | Tetsuo | |
| 4,534,773 | A | 8/1985 | Phaal et al. | |
| 4,595,623 | A | 6/1986 | Du Pont et al. | |
| 4,681,174 | A | 7/1987 | Aubakirov et al. | |
| 4,698,070 | A | 10/1987 | Ohno | |
| 4,822,757 | A | 4/1989 | Sadamori | |
| 4,863,490 | A | 9/1989 | Buljan et al. | |
| 5,025,871 | A | 6/1991 | Stewart et al. | |
| 5,052,153 | A | 10/1991 | Wiand | |
| 5,069,584 | A | 12/1991 | Obermeier et al. | |
| 5,092,910 | A | 3/1992 | deKok et al. | |
| 5,218,888 | A | 6/1993 | Merrill | |
| D342,270 | S | 12/1993 | Kwang | |
| 5,316,416 | A | 5/1994 | Kim | |
| 5,435,815 | A | 7/1995 | Ikegaya et al. | |
| 5,451,352 | A | 9/1995 | Cook | |
| 5,628,376 | A | 5/1997 | Kleine | |
| 5,644,956 | A | 7/1997 | Blackman et al. | |
| 5,645,617 | A * | 7/1997 | Frushour | 51/309 |
| 5,677,372 | A | 10/1997 | Yamamoto et al. | |
| 5,823,276 | A | 10/1998 | Beck, III | |
| 5,836,409 | A | 11/1998 | Vail, III | |
| 5,901,964 | A | 5/1999 | Williams et al. | |
| 5,932,508 | A | 8/1999 | Armstrong et al. | |
| 5,996,571 | A | 12/1999 | Jedick | |
| 6,084,052 | A | 7/2000 | Aufdermarsh et al. | |
| 6,196,908 | B1 * | 3/2001 | Adams | 451/461 |
| 6,273,924 | B1 | 8/2001 | Krenkel et al. | |
| 6,315,066 | B1 * | 11/2001 | Dennis | 175/431 |
| 6,390,890 | B1 | 5/2002 | Molnar | |
| 6,394,202 | B2 * | 5/2002 | Truax et al. | 175/434 |
| 6,399,737 | B1 | 6/2002 | Elkovitch | |
| 6,413,287 | B1 | 7/2002 | Barber, Jr. | |
| D466,139 | S | 11/2002 | Kim et al. | |
| 6,595,844 | B1 | 7/2003 | Mizuno et al. | |
| 6,607,835 | B2 | 8/2003 | Fang et al. | |
| 6,742,611 | B1 * | 6/2004 | Illerhaus et al. | 175/433 |
| 6,997,977 | B2 | 2/2006 | Dallas et al. | |
| 7,141,086 | B2 | 11/2006 | Endoh et al. | |
| 7,189,036 | B1 | 3/2007 | Watson | |
| 7,243,745 | B2 | 7/2007 | Skeem et al. | |
| 7,628,228 | B2 | 12/2009 | Drivdahl et al. | |
| 7,641,004 | B2 | 1/2010 | Lapointe | |
| 7,695,542 | B2 * | 4/2010 | Drivdahl et al. | 75/229 |
| 7,794,821 | B2 | 9/2010 | Sigalas | |
| 7,828,090 | B2 | 11/2010 | Drivdahl | |
| 7,866,419 | B2 | 1/2011 | Lockwood | |
| 7,972,397 | B2 | 7/2011 | Vail | |
| 8,191,445 | B2 | 6/2012 | Drivdahl | |
| 2002/0020564 | A1 | 2/2002 | Fang et al. | |
| 2003/0162648 | A1 | 8/2003 | Middlemiss | |
| 2004/0231245 | A1 | 11/2004 | Yamamoto et al. | |
| 2005/0016775 | A1 | 1/2005 | Hiranuma et al. | |
| 2005/0115743 | A1 | 6/2005 | Griffo | |
| 2005/0189647 | A1 | 9/2005 | Sung | |
| 2005/0247491 | A1 | 11/2005 | Mlrchandani et al. | |
| 2006/0243494 | A1 | 11/2006 | Koltermann et al. | |
| 2007/0051455 | A1 | 3/2007 | Franchet et al. | |
| 2007/0131456 | A1 | 6/2007 | Lapointe | |
| 2007/0215390 | A1 * | 9/2007 | Azar et al. | 175/426 |
| 2007/0246266 | A1 | 10/2007 | Larbo | |
| 2008/0035389 | A1 | 2/2008 | Hall | |
| 2008/0066969 | A1 | 3/2008 | Paul-Philippe | |
| 2008/0128170 | A1 * | 6/2008 | Drivdahl et al. | 175/58 |
| 2008/0142262 | A1 | 6/2008 | Drivdahl et al. | |
| 2008/0202821 | A1 * | 8/2008 | McClain et al. | 175/434 |
| 2008/0209818 | A1 | 9/2008 | Belnap et al. | |
| 2009/0071724 | A1 | 3/2009 | Drivdahl et al. | |
| 2009/0120008 | A1 * | 5/2009 | Lockwood et al. | 51/295 |
| 2009/0283326 | A1 | 11/2009 | Oothoudt | |
| 2009/0283335 | A1 | 11/2009 | Fulenchek | |
| 2009/0283336 | A1 | 11/2009 | Lockwood et al. | |
| 2010/0006344 | A1 | 1/2010 | Drivdahl et al. | |
| 2010/0012385 | A1 | 1/2010 | Drivdahl et al. | |
| 2010/0133013 | A1 * | 6/2010 | Hahati et al. | 175/61 |
| 2010/0320005 | A1 | 12/2010 | Burhan | |
| 2011/0259648 | A1 | 10/2011 | Sani | |

FOREIGN PATENT DOCUMENTS

| | | | |
|---|---|---|---|
| CN | 102459802 | | 5/2012 |
| EP | 0311422 | A1 | 4/1989 |
| EP | 0546725 | A1 | 6/1993 |
| EP | 2462311 | | 6/2012 |
| EP | 2475838 | | 7/2012 |
| GB | 2270493 | A | 3/1994 |
| JP | 03-243735 | | 10/1991 |
| JP | 11012090 | | 1/1999 |
| JP | 2004358580 | A | 12/2004 |
| JP | 2006255822 | A | 9/2006 |
| JP | 2007/022888 | | 2/2007 |
| RU | 2024727 | C | 12/1994 |
| WO | WO 98/45091 | | 10/1998 |
| WO | 0192677 | A1 | 12/2001 |
| WO | 2006004494 | A1 | 1/2006 |
| WO | 2006076795 | A1 | 7/2006 |
| WO | WO 2011/017607 | | 2/2011 |
| WO | WO 2011/017649 | | 2/2011 |
| WO | WO 2011/031912 | | 3/2011 |
| WO | WO 2011/042566 | | 4/2011 |
| WO | WO 2011/046838 | | 4/2011 |

OTHER PUBLICATIONS

Issue Notification dated Jun. 22, 2011 from U.S. Appl. No. 12/276,870, filed Nov. 24, 2008 (1 page).

Office Action dated Nov. 14, 2011 from U.S. Appl. No. 12/561,936, filed Sep. 17, 2009 (10 pages).

Notice of Allowance dated Jan. 10, 2012 from U.S. Appl. No. 12/561,936, filed Sep. 17, 2009 (7 pages).

Notice of Allowance dated Aug. 4, 2011 from U.S. Appl. No. 29/354,586, filed Jan. 26, 2010 (8 pages).

Notice of Allowance dated Aug. 4, 2011 from U.S. Appl. No. 29/354,592, filed Jan. 26, 2010 (8 pages).

Notice of Allowance dated Aug. 10, 2011 from U.S. Appl. No. 12/909,187, filed Oct. 21, 2010 (5 pages).

Office Action dated Oct. 13, 2010 from U.S. Appl. No. 29/354,586, filed Jan. 26, 2010 (6 pages).

Notice of Allowance dated Apr. 27, 2011 from U.S. Appl. No. 29/354,586, filed Jan. 26, 2010 (7 pages).

Office Action dated Jul. 28, 2008 from U.S. Appl. No. 11/610,680, filed Dec. 14, 2006 (8 pages).

Office Action dated Mar. 18, 2009 from U.S. Appl. No. 11/610,680, filed Dec. 14, 2006 (7 pages).

Office Action dated Jul. 7, 2009 from U.S. Appl. No. 11/610,680, filed Dec. 14, 2006 (7 pages).

Notice of Allowance dated Sep. 30, 2009 from U.S. Appl. No. 11/610,680, filed Dec. 14, 2006 (4 pages).

Issue Notification dated Nov. 18, 2009 from U.S. Appl. No. 11/610,680, filed Dec. 14, 2006 (1 page).

Issue Notification dated Mar. 16, 2011 from U.S. Appl. No. 12/564,779, filed Sep. 22, 2009 (1 page).

Notice of Allowance dated Jan. 21, 2011 from U.S. Appl. No. 12/564,779, filed Sep. 22, 2009 (4 pages).

Office Action dated Sep. 7, 2010 from U.S. Appl. No. 12/564,779, filed Sep. 22, 2009 (10 pages).

Notice of Allowance dated Jul. 19, 2010 from U.S. Appl. No. 12/564,779, filed Sep. 22, 2009 (4 pages).

(56) References Cited

OTHER PUBLICATIONS

Office Action dated Feb. 25, 2010 from U.S. Appl. No. 12/564,779, filed Sep. 22, 2009 (11 pages).
Notice of Allowance dated Jun. 2, 2011 from U.S. Appl. No. 12/909,187, filed Oct. 21, 2010 (5 pages).
Office Action dated Dec. 27, 2010 from U.S. Appl. No. 12/909,187, filed Oct. 21, 2010 (15 pages).
Office Action dated Apr. 26, 2010 from U.S. Appl. No. 12/564,540, filed Sep. 22, 2009 (7 pages).
Notice of Allowance dated Sep. 1, 2010 from U.S. Appl. No. 12/564,540, filed Sep. 22, 2009 (4 pages).
Issue Notification dated Oct. 20, 2010 from U.S. Appl. No. 12/564,540, filed Sep. 22, 2009 (1 page).
Office Action dated Jun. 1, 2010 from U.S. Appl. No. 12/567,477, filed Sep. 25, 2009 (9 pages).
Office Action dated Sep. 21, 2010 from U.S. Appl. No. 12/567,477, filed Sep. 25, 2009 (8 pages).
Issue Notification dated May 25, 2011 from U.S. Appl. No. 12/567,477, filed Sep. 25, 2009 (1 page).
Notice of Allowance dated Feb. 9, 2011 from U.S. Appl. No. 12/567,477, filed Sep. 25, 2009 (6 pages).
Issue Notification dated Jan. 5, 2011 from U.S. Appl. No. 12/568,231, filed Sep. 28, 2009 (1 page).
Notice of Allowance dated Sep. 30, 2010 from U.S. Appl. No. 12/568,231, filed Sep. 28, 2009 (9 pages).
Office Action dated Jun. 3, 2010 from U.S. Appl. No. 12/568,231, filed Sep. 28, 2009 (7 pages).
Issue Notification dated Mar. 2, 2011 from U.S. Appl. No. 12/568,204, filed Sep. 28, 2009 (1 page).
Notice of Allowance dated Nov. 26, 2010 from U.S. Appl. No. 12/568,204, filed Sep. 28, 2009 (7 pages).
Office Action dated Aug. 23, 2010 from U.S. Appl. No. 12/568,204, filed Sep. 28, 2009 (10 pages).
Office Action dated Mar. 8, 2010 from U.S. Appl. No. 12/568,204, filed Sep. 28, 2009 (11 pages).
Office Action dated Sep. 9, 2008 from U.S. Appl. No. 11/948,185, filed Nov. 30, 2007 (8 pages).
Office Action dated Jan. 26, 2009 from U.S. Appl. No. 11/948,185, filed Nov. 30, 2007 (7 pages).
Office Action dated Aug. 18, 2009 from U.S. Appl. No. 11/948,185, filed Nov. 30, 2007 (8 pages).
Office Action dated Oct. 5, 2009 from U.S. Appl. No. 11/948,185, filed Nov. 30, 2007 (7 pages).
Notice of Allowance dated Feb. 12, 2010 from U.S. Appl. No. 11/948,185, filed Nov. 30, 2007 (8 pages).
Issue Notification dated Mar. 24, 2010 from U.S. Appl. No. 11/948,185, filed Nov. 30, 2007 (1 page).
Office Action dated Aug. 3, 2009 from U.S. Appl. No. 12/276,903, filed Nov. 24, 2008 (9 pages).
Office Action dated Sep. 24, 2009 from U.S. Appl. No. 12/276,903, filed Nov. 24, 2008 (12 pages).
Office Action dated Jan. 19, 2010 from U.S. Appl. No. 12/276,903, filed Nov. 24, 2008 (10 pages).
Office Action dated Apr. 27, 2010 from U.S. Appl. No. 12/276,903, filed Nov. 24, 2008 (12 pages).
Office Action dated May 21, 2009 from U.S. Appl. No. 12/276,870, filed Nov. 24, 2008 (11 pages).
Office Action dated Nov. 27, 2009 from U.S. Appl. No. 12/276,870, filed Nov. 24, 2008 (9 pages).
Office Action dated May 12, 2010 from U.S. Appl. No. 12/276,870, filed Nov. 24, 2008 (7 pages).
Office Action dated Oct. 19, 2010 from U.S. Appl. No. 12/276,870, filed Nov. 24, 2008 (8 pages).
Notice of Allowance dated Mar. 7, 2011 from U.S. Appl. No. 12/276,870, filed Nov. 24, 2008 (9 pages).
Notice of Allowance dated Apr. 5, 2010 from U.S. Appl. No. 29/354,579, filed Jan. 26, 2010 (6 pages).
Notice of Allowance dated Jun. 1, 2010 from U.S. Appl. No. 29/354,579, filed Jan. 26, 2010 (6 pages).
Issue Notification dated Aug. 11, 2010 from U.S. Appl. No. 29/354,579, filed Jan. 26, 2010 (1 page).
Notice of Allowance dated Jul. 19, 2011 from U.S. Appl. No. 29/354,592, filed Jan. 26, 2010 (8 pages).
Boart Longyear, Alpha Bit, 2003 (1 page).

* cited by examiner

IMPREGNATED CUTTING ELEMENTS WITH LARGE ABRASIVE CUTTING MEDIA AND METHODS OF MAKING AND USING THE SAME

CROSS-REFERENCE TO RELATED APPLICATIONS

This application claims the benefit of U.S. Provisional Application No. 61/244,806, filed Sep. 22, 2009, entitled "Cutting Elements Impregnated with Polycrystalline Diamond Materials," the contents of which are hereby incorporated by reference in their entirety.

BACKGROUND OF THE INVENTION

1. The Field of the Invention

Implementations of the present invention relate generally to drilling tools that may be used to drill geological and/or manmade formations. In particular, implementations of the present invention relate to impregnated cutting elements with large abrasive cutting media, such as polycrystalline diamonds embedded therein, as well as methods for making and using such drill bits.

2. The Relevant Technology

Drill bits and other drilling tools can be used to drill holes in rock and other formations for exploration or other purposes. For example, a drill bit can be attached on the lower end of a drill string (i.e., a series of connected drill rods coupled to a drill head). A drill head or downhole motors, or both, can then rotate the drill string, and in turn the drill bit. A downward force can then be applied to the drill bit, which can cause the drill bit to engage the formation and form a borehole within the formation.

The type of drill bit selected for a particular drilling operation can be based on the type and hardness of the formation being drilled. For example, surface-set bits or drill bits having fixed cutters can be used to drill soft to medium-hard formations. The fixed cutters or inserts of these drill bits can be designed to penetrate quickly due to the depth of cut per revolution. One commonly used type of fixed cutter is a polycrystalline diamond compact (PDC) insert. The PDC inserts are often distributed along the cutting face of the drill bit in specific orientations and positions. While surface-set or fixed cutter drill bits can provide various benefits, because the inserts typically only include a single layer of diamond, the life of such drill bits can be limited.

Furthermore, in drilling hard and/or abrasive formations, surface-set bits can be ineffective or inefficient. Thus, for harder formations, impregnated drill bits with renewable cutting elements are typically preferred. Impregnated drill bits typically include a cutting portion or crown that may include a matrix containing a powdered hard particulate material, such as tungsten carbide and/or other refractory or ceramic compounds. The hard particulate material may be sintered and/or infiltrated with a binder, such as a copper-based alloy. Furthermore, the cutting portion of impregnated drill bits may also be impregnated with an abrasive cutting media, such as natural or synthetic diamonds.

During drilling operations, the abrasive cutting media is gradually exposed as the supporting matrix material is worn away. The continuous exposure of new abrasive cutting media by wear of the supporting matrix forming the cutting portion can help provide a continually sharp cutting surface. Additionally, as the entire crown may function the cutting element as it erodes during drilling, impregnated drill bits can have an increased cutting life. Impregnated drill bit may continue to cut efficiently until the cutting portion of the tool is consumed. Once the cutting portion of the tool is consumed, the tool becomes dull and requires replacement.

While impregnated drill bits can be effective and efficient in drilling harder formations, they may be ineffective or inefficient in drilling soft formations due to the size of abrasive material used in impregnated bits. Along similar lines, while surface-set bits can be effective and efficient in drilling softer formations, they may be ineffective or inefficient for drilling hard and/or abrasive formations. Thus, when drilling formations that contain both hard and soft regions, it may be desirable to switch between a surface-set bit and an impregnated drill bit. The replacement of a drill bit requires removing (or tripping out) the entire drill string out of a borehole. Once the drill bit is replaced, the entire drill string typically is then assembled section by section and then tripped back into the borehole. Switching a drill bit can be time consuming, difficult, and potentially dangerous.

Accordingly, there are a number of disadvantages in conventional drill bits that can be addressed.

BRIEF SUMMARY OF THE INVENTION

One or more implementations of the present invention overcome one or more problems in the art with drilling tools, systems, and methods for effectively and efficiently drilling through formations. For example, one or more implementations of the present invention include impregnated drill bits having relatively large abrasive cutting media, such as polycrystalline diamonds, embedded therein. In particular, the relatively large abrasive cutting media can be dispersed in an unorganized arrangement throughout at least a portion of the crown. The relatively large abrasive cutting media can allow the drill bit to quickly remove the material of a formation being drilled due to the large depth of cut per revolution associated with large coated or uncoated abrasive material. Additionally, one or more implementations can provide increased longevity by providing additional, sub-surface large abrasive cutting media that are exposed as the crown of the drill bit wears during drilling. Accordingly, implementations of the present invention can increase the cutting speed of the drill bit as well as its durability and longevity.

For example, one implementation of an impregnated drill bit can comprise a shank having a first end and an opposing second end. The first end of the shank can be adapted to be secured to a drill string component. A crown can extend from said second end of the shank. The crown can include a matrix of hard particulate material, a cutting face, and a crown body between the cutting face and the shank. The impregnated drill bit can also include a first plurality of abrasive cutting media having at least one dimension between about 2.5 millimeters and about 5 millimeters. The first plurality of abrasive cutting media can be positioned in an unorganized arrangement throughout at least a portion of the crown body.

Additionally, an implementation of an impregnated drill bit can include a shank and a cutting portion secured to the shank. The cutting portion can include a matrix of hard particulate material, a first plurality of abrasive cutting media disbursed throughout at least a portion of the cutting portion, and a second plurality of abrasive cutting media disbursed throughout at least a portion of said cutting portion. At least one abrasive cutting media of the first plurality of abrasive cutting media can have a first volume. At least one abrasive cutting media of the second plurality of abrasive cutting media can have a second volume. The second volume can be less than about 0.75 times the first volume.

Furthermore, an implementation of a drilling system can include a drill rig, a drill string adapted to be secured to and rotated by the drill rig, and an impregnated drill bit adapted to be secured to the drill string. The impregnated drill bit can comprise a shank and a crown. The crown can include a plurality of polycrystalline diamonds having at least one dimension between about 2.5 millimeters and about 5 millimeters. The plurality of polycrystalline diamonds can be disbursed in an unorganized arrangement throughout at least a portion of the crown.

An implementation of a method of forming an impregnated drill bit can involve preparing a matrix of hard particulate material. The method can also involve dispersing a first plurality of abrasive cutting media throughout at least a portion of the matrix. Abrasive cutting media of the first plurality of abrasive cutting media can have at least one dimension between about 2.5 millimeters and about 5 millimeters. Additionally, the method can involve dispersing a second plurality of abrasive cutting media throughout at least a portion of matrix. Abrasive cutting media of the second plurality of abrasive cutting media can have a largest dimension less than about 2 millimeters. Furthermore, the method can involve infiltrating the matrix with a binder material and securing a shank to the matrix.

In addition to the foregoing, a method of drilling can comprise securing an impregnated drill bit to a drill string. A crown of the impregnated drill bit can comprise a hard particulate material, a binder material, a first plurality of abrasive cutting media, and a second plurality of abrasive cutting media. Each abrasive cutting media of the first plurality of abrasive cutting media can have a volume between about 8 $mm^3$ and about 125 $mm^3$. The first plurality of abrasive cutting media can be dispersed throughout at least a portion of the crown in an unorganized arrangement. The method can also involve rotating the drill string to cause the impregnated drill bit to penetrate an earthen formation.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
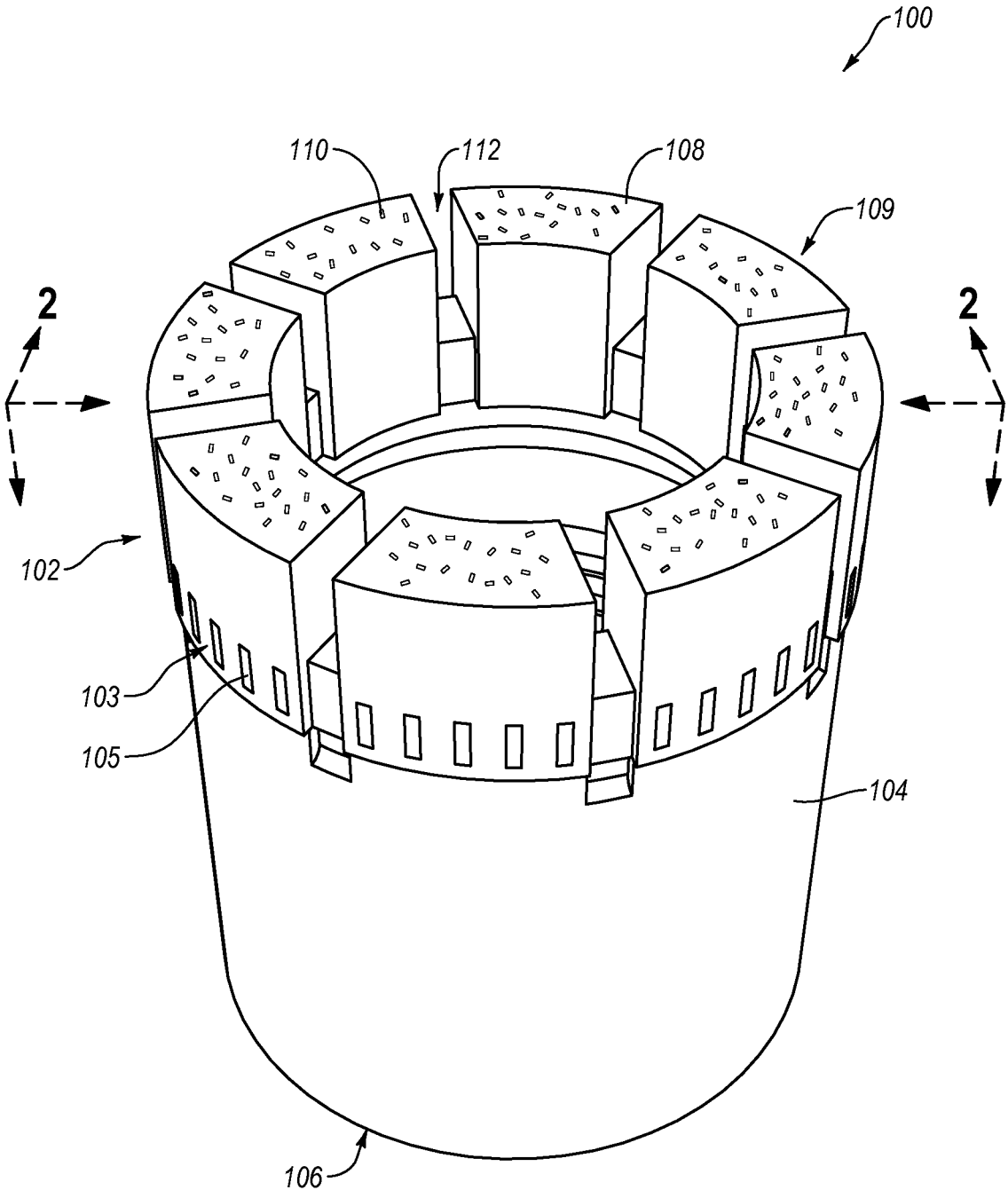
FIG. 1 illustrates perspective view of an impregnated drill bit including a plurality of relatively large abrasive cutting media in accordance with an implementation of the present invention.

Implementations of the present invention are directed toward drilling tools, systems, and methods for effectively and efficiently drilling through formations. For example, one or more implementations of the present invention include impregnated drill bits having relatively large abrasive cutting media, such as polycrystalline diamonds, embedded therein. In particular, the relatively large abrasive cutting media can be dispersed in an unorganized arrangement throughout at least a portion of the crown. The relatively large abrasive cutting media can allow the drill bit to quickly remove the material of a formation being drilled due to the large depth of cut per revolution associated with large coated or uncoated abrasive material. Additionally, one or more implementations can provide increased longevity by providing additional, subsurface large abrasive cutting media that are exposed as the crown of the drill bit wears during drilling. Accordingly, implementations of the present invention can increase the cutting speed of the drill bit as well as its durability and longevity.

One will appreciate in light of the disclosure herein that impregnated drill bits having relatively large abrasive cutting media according to one or more implementations of the present invention can function as a hybrid drill bit and provide many of the benefits of both surface-set drill bits and impregnated drill bits. For example, the relatively large abrasive cutting media can cut more formation material per revolution allowing impregnated drill bits of one or more implementations to cut effectively and efficiently through softer formations. Thus, one or more implementations can include an impregnated drill bit that can cut through softer formations at relatively high cutting speeds. Additionally, the relatively large abrasive cutting media, or small abrasive media if included, can still cut hard formation material, allowing impregnated drill bits of one or more implementations to cut effectively and efficiently through harder formations. Furthermore, as the relatively large abrasive cutting media and the matrix at the cutting face wear, embedded cutting media are exposed to replenish the cutting face. Such a configuration can provide versatility in cutting as cutting media continue to be available to cut throughout the life of the impregnated drill bit.

The drilling tools described herein can be used to cut stone, subterranean mineral deposits, ceramics, asphalt, concrete, and other hard materials. These drilling tools can include, for example, core-sampling drill bits, drag-type drill bits, reamers, stabilizers, casing or rod shoes, and the like. For ease of description, the Figures and corresponding text included hereafter illustrate examples of impregnated, core-sampling drill bits, and methods of forming and using such drill bits. One will appreciate in light of the disclosure herein; however, that the systems, methods, and apparatus of the present invention can be used with other impregnated drilling and cutting tools, such as those mentioned hereinabove.

Figure 2:
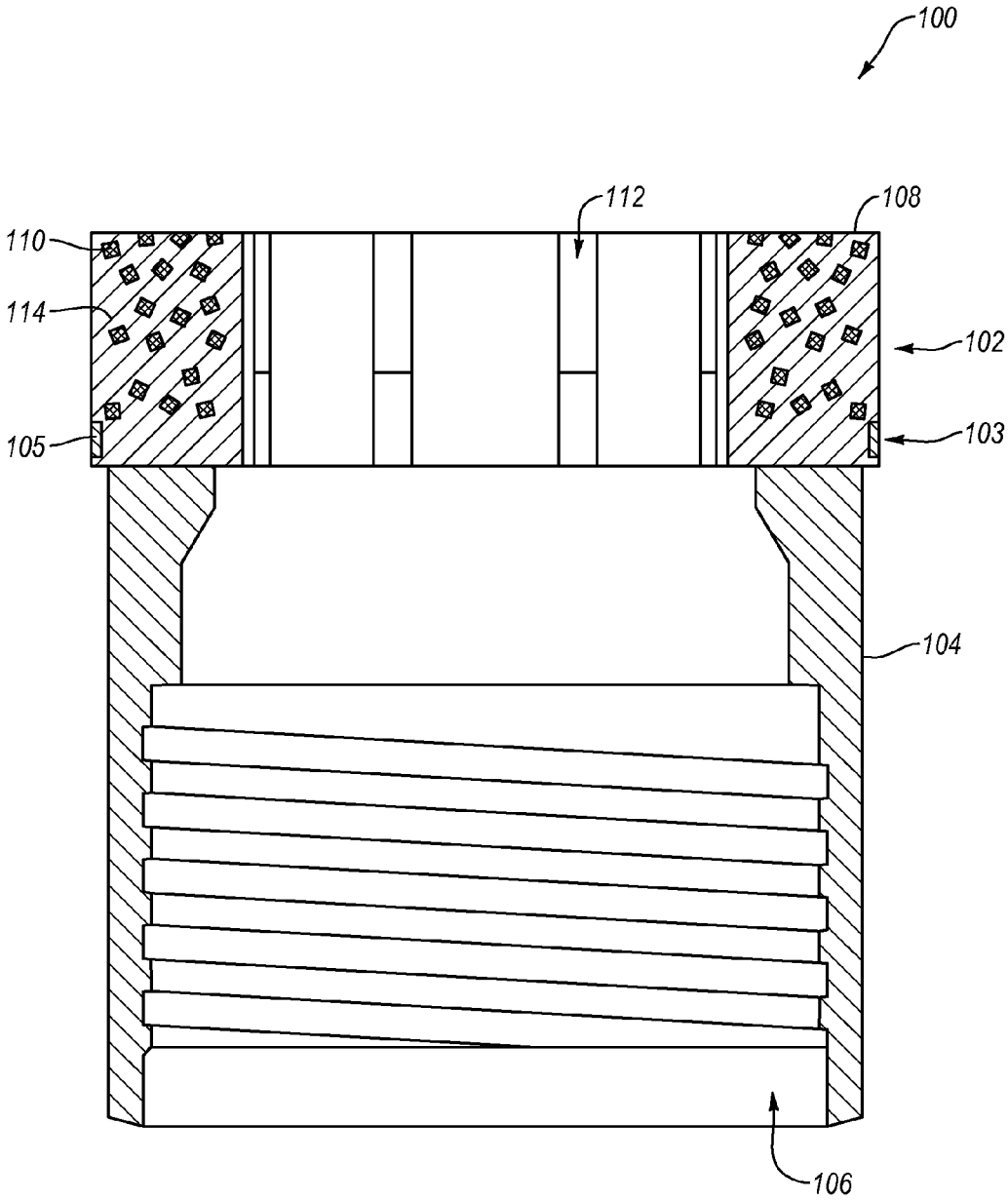
FIG. 2 illustrates a cross-sectional view of the impregnated drill bit of FIG. 1 taken along the line 2-2 of FIG. 1.

Referring now to the Figures, FIGS. 1 and 2 illustrate a perspective view and a cross-sectional view, respectively, of an impregnated drill bit 100. More particularly, FIGS. 1 and 2 illustrate an impregnated, core-sampling drill bit 100 with relatively large abrasive cutting media according to an implementation of the present invention. As shown in FIG. 1, the drill bit 100 can include a cutting portion or crown 102.

A backing layer 103 can secure or connect the crown 102 to a shank or blank 104. As explained in greater detail below, the crown 102 can include a matrix layer having therein the abrasive cutting media that abrades and cuts the material being drilled. As shown by FIG. 2, the backing layer 103, which connects the crown 102 to the shank 104, can be devoid of abrasive cutting media. In alternative implementations, the backing layer 103 can include abrasive cutting media.

As shown by FIGS. 1 and 2, in some implementations of the present invention, the backing layer 103 can include pins 105. The pins 105 can be formed from polycrystalline diamonds, tungsten carbide, or other materials with similar material characteristics. The pins 105 can help maintain the bit gauge and help stabilize the impregnated drill bit 100. In alternative implementations, the backing layer 103 may not include pins 105.

Figure 3:
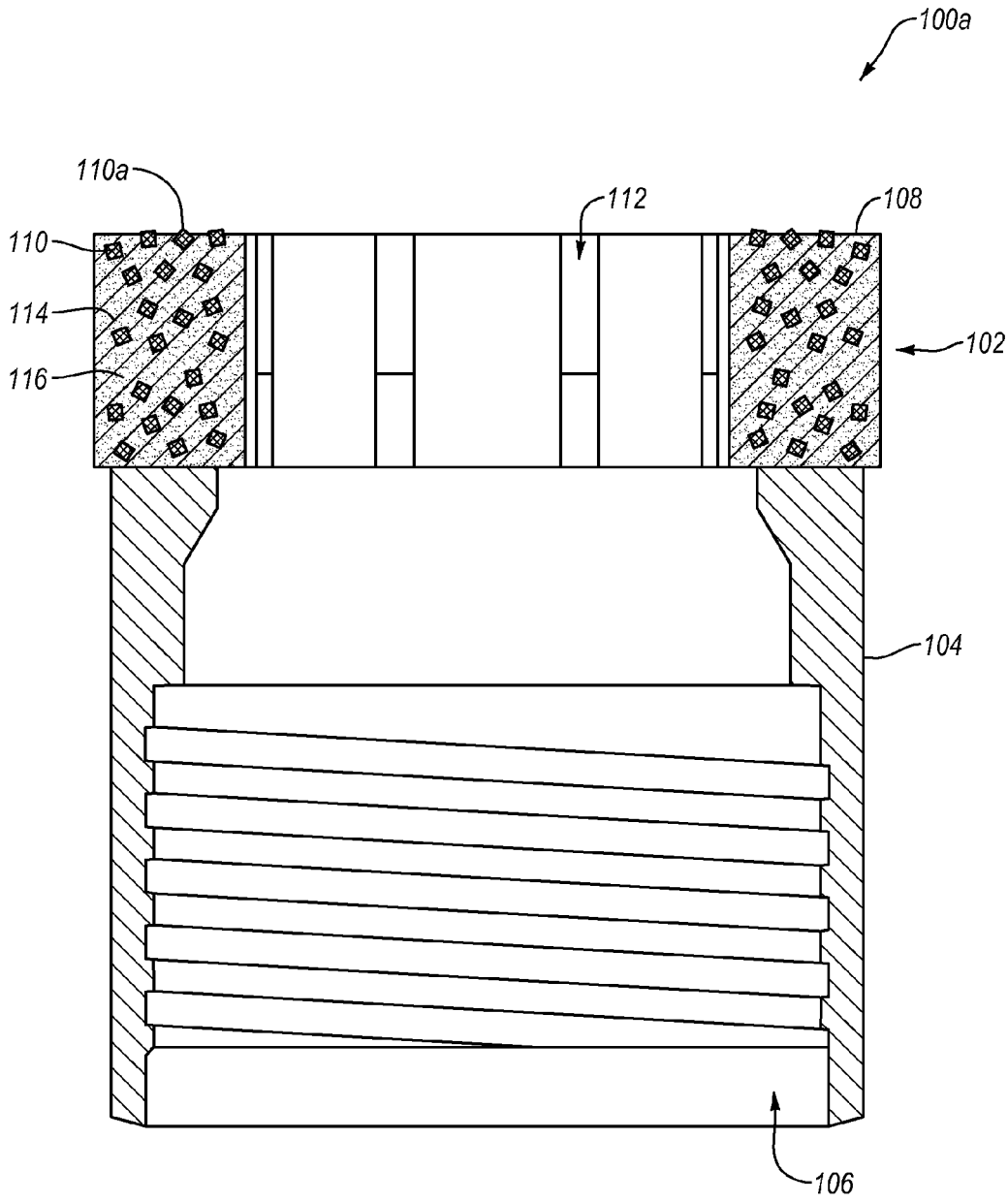
FIG. 3 illustrates a cross-sectional view of an impregnated drill bit including a plurality of relatively large abrasive cutting media and a plurality of small abrasive cutting media in accordance with an implementation of the present invention.

The shank 104 can be configured to connect the impregnated drill bit 100 to a component of a drill string. In particular, the upper end of the shank 104 (i.e., the end opposite the end secured to the backing layer 103) can include a connector 106 to which a reaming shell or other drill string component can be secured. As shown in FIG. 3, in one or more implementations the connector 106 can comprise threads.

FIGS. 1 and 2 also illustrate that the drill bit 100 can define an interior space about its central axis for receiving a core sample. Thus, both the crown 102 and the shank 104 can have a generally annular shape defined by an inner surface and outer surface. Accordingly, pieces of the material being drilled can pass through the interior space of the impregnated drill bit 100 and up through an attached drill string. The impregnated drill bit 100 may be any size, and therefore, may be used to collect core samples of any size. While the impregnated drill bit 100 may have any diameter and may be used to remove and collect core samples with any desired diameter, the diameter of the impregnated drill bit 100 can range in some implementations from about 1 inch to about 12 inches. As well, while the kerf of the impregnated drill bit 100 (i.e., the radius of the outer surface minus the radius of the inner surface) may be any width, according to some implementations the kerf can range from about ¼ inches to about 6 inches.

The crown 102 can be configured to cut or drill the desired materials during the drilling process. The crown 102 can include a cutting face 108 and a crown body extending between the backing layer 103 or shank 104 and the cutting face 108. In particular, the crown 102 of the impregnated drill bit 100 can include a plurality of cutting elements or segments 109. The cutting elements 109 can be separated by waterways 112. The waterways 112 can allow drilling fluid or other lubricants to flow across the cutting face 108 to help provide cooling during drilling. The waterways 112 can allow also drilling fluid to flush cuttings and debris from the inner surface to the outer surface of the impregnated drill bit 100.

The crown 104 may have any number of waterways 112 that provides the desired amount of fluid/debris flow and also allows the crown 102 to maintain the structural integrity needed. For example, FIGS. 1 and 2 illustrate that the impregnated drill bit 100 includes eight waterways 112. One will appreciate in light of the disclosure herein that the present invention is not so limited. In additional implementations, the impregnated drill bit 100 can include as few as one waterway or as many 20 or more waterways, depending on the desired configuration and the formation to be drilled. Additionally, the waterways 112 may be evenly or unevenly spaced around the circumference of the crown 102. For instance, FIG. 1 depicts eight waterways 112 evenly spaced from each other about the circumference of the crown 102. In alternative implementations, however, the waterways 112 can be staggered or otherwise not evenly spaced.

As shown by FIGS. 1 and 2, the crown 102 can comprise a plurality of relatively large abrasive cutting media 110 dispersed within a matrix 114. The relatively large abrasive cutting media 110 can allow the impregnated drill bit 100 to quickly cut soft formation material by removing more material per revolution.

As used herein, the term "relatively large" refers to abrasive cutting media having (i) at least one dimension between about 1.0 millimeter and about 8 millimeters, or more preferably between about 2.5 millimeters and about 5 millimeters, or (ii) having a volume of between about 1 millimeter$^3$ and about 512 millimeters$^3$, or more preferably between about 15.2 millimeters$^3$ and about 125 millimeters$^3$, or (iii) a size between about 108 carats per stone and about 5 carats per stone.

The relatively large abrasive cutting media 110 can have varied shapes or combinations thereof, such as, for example, the spheres, cubes, cylinders, irregular shapes, or other shapes. The "at least one dimension" of the relatively large abrasive cutting media 110 can thus comprise a length, a diameter, a width, a height, or other dimension. For example, FIG. 2 illustrates relatively large abrasive cutting media having a cubic shape. The relatively large abrasive cutting media can include one or more of natural diamond, synthetic diamond, polycrystalline diamond, thermally stable diamond, aluminum oxide, silicon carbide, silicon nitride, tungsten carbide, cubic boron nitride, boron carbide, alumina, seeded or unseeded sol-gel alumina, other suitable materials, or combinations thereof. In one or more implementations, the relatively large abrasive cutting media 110 can comprise homogenous polycrystalline diamond materials, such as thermally stable diamonds that do not have a carbide backing.

Additionally, in some implementations, the relatively large abrasive cutting media can include a coating of one or more materials. The coating include metal, ceramic, polymer, glass, other materials or combinations thereof. For example, the relatively large abrasive cutting media can be coated with a metal, such as iron, titanium, nickel, copper, molybdenum, lead, tungsten, aluminum, chromium, or combinations or alloys thereof. In another implementation, the relatively large abrasive cutting media may be coated with a ceramic material, such as SiC, SiO, Si02, or the like.

The coating may cover all of the surfaces of the relatively large abrasive cutting media, or only a portion thereof. Additionally, the coating can be of any desired thickness. For example, in some implementations, the coating may have a thickness of about one to about 20 microns. The coating may be applied to the relatively large abrasive cutting media through spraying, brushing, electroplating, immersion, vapor deposition, or chemical vapor deposition.

In some implementations, the coating can help bond the relatively large abrasive cutting media to the matrix. Additionally or alternatively, the coating can help provide temperature protection to the relatively large abrasive cutting media. Still further, or alternatively, the coating can increase or otherwise modify the wear properties of the relatively large abrasive cutting media.

FIG. 2 illustrates that the relatively large abrasive cutting media 110 can be dispersed at the cutting face 108 of the crown 102. In addition, FIG. 2 shows that the relatively large abrasive cutting media 110 can be dispersed throughout at least a portion of the crown body (i.e., the portion of the crown 102 between the cutting face 108 and the backing layer 103 or shank 104). In other words, the relatively large abrasive cutting media 110 can be embedded in within the crown 102 at the cutting face 108, as well as behind the cutting face 108. Thus, as the relatively large abrasive cutting media 110 and the matrix 114 on the cutting face 108 wear or erode during a drilling process, the embedded relatively large abrasive cutting media 110 are exposed to replenish the cutting face 108. Such a configuration can provide versatility in cutting as relatively large abrasive cutting media 110 continue to be available to cut throughout the life of the impregnated drill bit 100.

The relatively large abrasive cutting media 110 can be dispersed throughout at least a portion of the crown 102. For example, FIG. 2 illustrates that the relatively large abrasive cutting media 110 are dispersed substantially entirely throughout the crown 102. In alternative implementations, the relatively large abrasive cutting media 110 may be dispersed throughout only a portion of the crown 102. For instance, in some implementations the relatively large abrasive cutting media 110 may be dispersed only in the portions of the crown 102 proximate the cutting face 108. In yet further implementations, the relatively large abrasive cutting media 110 can be dispersed only in portions of the crown 102 behind the cutting face 108.

As shown in FIG. 2, the relatively large abrasive cutting media 110 can be arranged in the crown 102 in an unorganized arrangement. In additional implementations, the relatively large abrasive cutting media 110 can be randomly dispersed within the crown 102. Thus, in at least one implementation of the present invention, the relatively large abrasive cutting media 110 are not arranged in specific alignments relative to each other or the cutting face 108. In alternative implementations, the relatively large abrasive cutting media 110 may be aligned in a particular manner so that the cutting properties of the cutting media are presented in an advantageous position with respect to the cutting face 108.

In any event, as FIG. 2 illustrates, the relatively large abrasive cutting media 110 may be dispersed substantially homogeneously throughout the crown 102. In alternative implementations, the relatively large abrasive cutting media 110 can be dispersed heterogeneously throughout the crown 102. For example, in some implementations, the concentration of relatively large abrasive cutting media 110 may vary throughout any portion of the crown 102, as desired. In particular, the crown 102 can include a gradient of relatively large abrasive cutting media 110. For instance, the portion of the crown 102 that is closest to the cutting face 108 of the impregnated drill bit 100 may contain a first concentration of relatively large abrasive cutting media 110, and the concentration of relatively large abrasive cutting media 110 can gradually decrease or increase towards the backing layer 103. Such an impregnated drill bit 100 may be used to drill a formation that begins with a soft, abrasive, unconsolidated formation, which gradually shifts to a hard, non-consolidated formation. Thus, the dispersal of the relatively large abrasive cutting media 110 in the impregnated drill bit 100 can be customized to the desired formation through which it will be used to drill.

As mentioned previously, the relatively large abrasive cutting media 110 can be dispersed within a matrix 114. The matrix 114 can comprise a hard particulate material, such as, for example, a metal or ceramic. One will appreciate in light of the disclosure herein, that the hard particulate material may include a powered material, such as, for example, a powered metal or alloy, as well as ceramic compounds. According to some implementations of the present invention the hard particulate material can include tungsten carbide. As used herein, the term "tungsten carbide" means any material composition that contains chemical compounds of tungsten and carbon, such as, for example, WC, W2C, and combinations of WC and W2C. Thus, tungsten carbide includes, for example, cast tungsten carbide, sintered tungsten carbide, and macrocrystalline tungsten. According to additional or alternative implementations of the present invention, the hard particulate material can include carbide, tungsten, iron, cobalt, and/or molybdenum and carbides, borides, alloys thereof, or any other suitable material.

Additionally, while not shown in the figures, the crown 102 can also include a binder. The binder can comprise copper, zinc, silver, molybdenum, nickel, cobalt, or mixture and alloys thereof. The binder can bond to the matrix 114 and the relatively large abrasive cutting media 110, thereby binding the crown 102 together.

As mentioned previously, one or more implementations of the present invention can include impregnated drill bits including small abrasive cutting media in addition to relatively large abrasive cutting media. For example, FIG. 3 illustrates a cross-sectional view of an impregnated drill bit 100*a* that includes a plurality of small abrasive cutting media 116 in addition to relatively large abrasive cutting media 110.

FIG. 3 shows that the small abrasive cutting media 116 can be dispersed within a matrix 114 along with the relatively large abrasive cutting media 110. The small abrasive cutting media 116 can cut a formation using abrasion. Thus, the small abrasive cutting media 116 can allow the impregnated drill bit 100*a* to efficiently cut through harder formations.

As used herein, the term "small" refers to abrasive cutting media having (i) a largest dimension less than about 2 millimeters, or more preferably between about 0.01 millimeters and about 1.0 millimeters, or (ii) having a volume that is less than about 0.75 times the volume of a relatively large abrasive cutting media, or more preferably less than about 0.50 times the volume of a relatively large abrasive cutting media, or (iii) a volume between about 0.001 $mm^3$ and about 8 $mm^3$.

The small abrasive cutting media 116 can have varied shapes or combinations thereof, such as, for example, spheres, cubes, cylinders, irregular shapes, or other shapes. The "largest dimension" of the small abrasive cutting media 116 can thus comprise a length, a diameter, a width, a height, or other dimension. The small abrasive cutting media 116 can include one or more of natural diamond, synthetic diamond, polycrystalline diamond, thermally stable diamond, aluminum oxide, silicon carbide, silicon nitride, tungsten carbide, cubic boron nitride, boron carbide, alumina, seeded or unseeded sol-gel alumina, other suitable materials, or combinations thereof. In one or more implementations, the small abrasive cutting media 116 can comprise single diamond crystals.

FIG. 3 illustrates that the small abrasive cutting media 116 can be dispersed at the cutting face 108 of the crown 102. In addition, FIG. 3 shows that the small abrasive cutting media 116 can be dispersed throughout at least a portion of the crown body (i.e., the portion of the crown 102 between the cutting face 108 and the shank 104). In other words, the small abrasive cutting media 116 can be embedded in within the crown 102 at the cutting face 108, as well as behind the cutting face 108. Thus, as the relatively large abrasive cutting media 110, the small abrasive cutting media 116, and the matrix 114 on the cutting face 108 wear or erode during a drilling process, the embedded relatively large abrasive cutting media 110 and the small abrasive cutting media 116 can be exposed to replenish the cutting face 108. Such a configuration can provide versatility in cutting as relatively large abrasive cutting media 110 and small abrasive cutting media 116 continue to be available to cut throughout the life of the impregnated drill bit 100*a*.

The small abrasive cutting media 116 can be dispersed throughout at least a portion of the crown 102. For example, FIG. 3 illustrates that the small abrasive cutting media 116 are dispersed substantially entirely throughout the crown 102. In alternative implementations, the small abrasive cutting media 116 may be dispersed throughout only a portion of the crown 102. For instance, in some implementations the small abrasive cutting media 116 may be dispersed only in the portions of the crown 102 proximate the cutting face 108. In yet further implementations, the small abrasive cutting media 116 can be dispersed only in portions of the crown 102 behind the cutting face 108.

As shown in FIG. 3, the small abrasive cutting media 116 can be arranged in the crown 102 in an unorganized arrangement. In additional implementations, the small abrasive cutting media 116 can be randomly dispersed within the crown 102. Thus, in at least one implementation of the present invention, the small abrasive cutting media 116 are not arranged in specific alignments relative to each other or the cutting face 108.

In any event, as FIG. 3 illustrates, the small abrasive cutting media 116 may be dispersed homogeneously throughout the crown 102. In alternative implementations, the small abrasive cutting media 116 can be dispersed heterogeneously throughout the crown 102. For example, in some implementations, the concentration of the small abrasive cutting media 116 may vary throughout any desired portion of the crown 102, as desired. In particular, the crown 102 can include a gradient of small abrasive cutting media 116. For instance, the portion of the crown 102 that is closest to the cutting face 108 of the impregnated drill bit 100*a* may contain a first concentration of small abrasive cutting media 116 and the concentration of small abrasive cutting media 116 can gradually decrease or increase towards the shank 104. Such an impregnated drill bit 100*a* may be used to drill a formation that begins with a soft, abrasive, unconsolidated formation, which gradually shifts to a hard, non-consolidated formation. Thus, the dispersal of the relatively large abrasive cutting media 110 and the small abrasive cutting media 116 in the impregnated drill bit 100*a* can be customized to the desired formation through which it will be drilling.

FIG. 3 further illustrates that in one or more implementations of the present invention the relatively large abrasive cutting media 110*a* at the cutting face 108 can extend out of the cutting face 108. In other words, the relatively large abrasive cutting media 110*a* can extend from the crown 102 axially away from the cutting face 108. The relatively large abrasive cutting media 110*a* can help allow for a quick start-up of a new drilling tool 100*a*. In alternative implementations, the cutting face 108 may not relatively large abrasive cutting media 110*a* that extend out of the cutting face 108, such as the impregnated drill bit 100 of FIGS. 1 and 2. In yet further implementations, the cutting face 108 can include other features for aiding in the drilling process, such as for example radial grooves.

Figure 4:
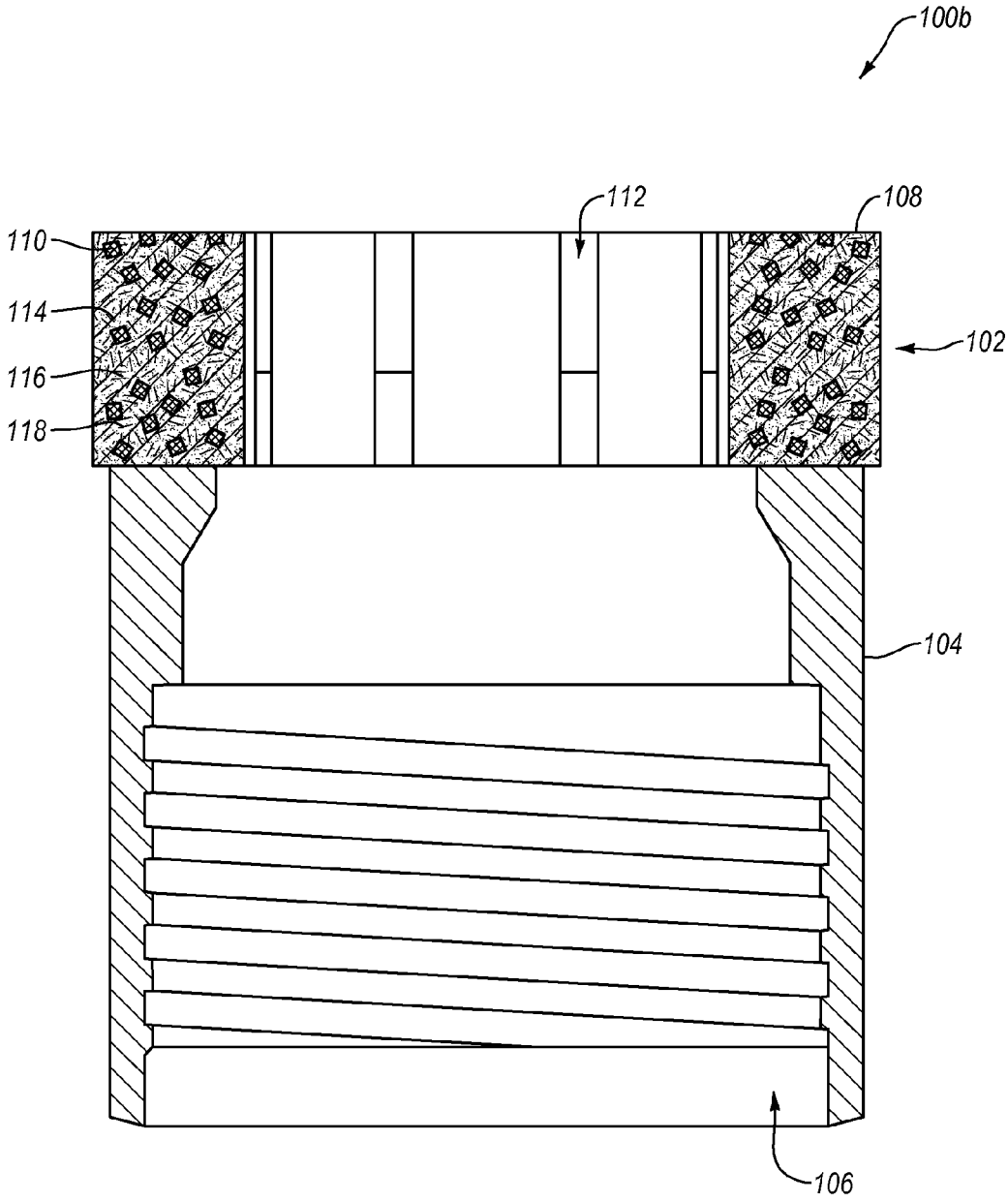
FIG. 4 illustrates a cross-sectional view of an impregnated drill bit including a plurality of relatively large abrasive cutting media, a plurality of small abrasive cutting media, and a plurality of fibers in accordance with an implementation of the present invention.

FIG. 4 illustrates yet an additional implementation of an impregnated drill bit including relatively large abrasive cutting media. In particular, FIG. 4 illustrates an impregnated drill bit 100*b* that includes a crown 102 having relatively large abrasive cutting media 110, small abrasive cutting media 116, and a plurality of fibers 118 dispersed within a matrix 114 of hard particulate material. In particular, the crown 102 of one or more implementations of the present invention can include fibers, such as the fibers described in U.S. patent application Ser. No. 11/948,185, filed Nov. 30, 2007, entitled "Fiber-Containing Diamond Impregnated Cutting Tools," now U.S. Pat. No. 7,695,542, the content of which is hereby incorporated herein by reference in its entirety. In one or more implementations of the present invention, the fibers 118 can help control the rate at which the matrix 118 erodes, and thus, the rate at which the abrasive cutting media, whether relatively large 110 or small 116, is exposed.

The fibers 118 can have varied shapes or combinations thereof, such as, for example, ribbon-like, cylindrical, polygonal, elliptical, straight, curved, curly, coiled, bent at angles, etc. The fibers 118 in the crown 102 of the impregnated drill bit 100*b* may be of any size or combination of sizes, including mixtures of different sizes. The fibers 118 may be of any length and have any desired diameter. In some implementations, the fibers 118 may be between about 10 microns and about 25,000 microns in length and may have a diameter of between about 1 micron and about 500 microns. In other implementations, the fibers 118 may be approximately 150 microns in length and may have a diameter of approximately 7 microns.

The fibers 118 can include one or more of carbon fibers, metal fibers (e.g., fibers made of tungsten, tungsten carbide, iron, molybdenum, cobalt, or combinations thereof), glass fibers, polymeric fibers (e.g., fibers made of Kevlar), ceramic fibers (e.g., fibers made of silicon carbide), coated fibers, and/or the like.

FIG. 4 illustrates that the fibers 118 can be dispersed at the cutting face 108 of the crown 102. In addition, FIG. 4 shows that the fibers 118 can be dispersed throughout at least a portion of the crown body (i.e., the portion of the crown 102 between the cutting face 108 and the shank 104). In other words, the fibers 118 can be embedded in within the crown 102 at the cutting face 108, as well as behind the cutting face 108.

The fibers 118 can be dispersed throughout at least a portion of the crown 102. For example, FIG. 4 illustrates that the fibers 118 are dispersed substantially entirely throughout the crown 102. In alternative implementations, the fibers 118 may be dispersed throughout only a portion of the crown 102. For instance, in some implementations the fibers 118 may be dispersed only in the portions of the crown 102 proximate the cutting face 108. In yet further implementations, the fibers 118 can be dispersed only in portions of the crown 102 behind the cutting face 108.

As shown in FIG. 4, the fibers 118 can be arranged in the crown 102 in an unorganized arrangement. In additional implementations, the fibers 118 can be randomly dispersed within the crown 102. Thus, in at least one implementation of the present invention, the fibers 118 are not arranged in specific alignments relative to each other or the cutting face 108.

In any event, as FIG. 4 illustrates, the fibers 118 may be dispersed homogeneously throughout the crown 102. In alternative implementations, the fibers 118 can be dispersed heterogeneously throughout the crown 102. For example, in some implementations, the concentration of the fibers 118 may vary throughout any portion of the crown 102, as desired. In particular, the crown 102 can include a gradient of fibers 118. For instance, the portion of the crown 102 that is closest to the cutting face 108 of the impregnated drill bit 100*b* may contain a first concentration of fibers 118 and the concentration of fibers 118 can gradually decrease or increase towards the shank 104.

Figure 5:
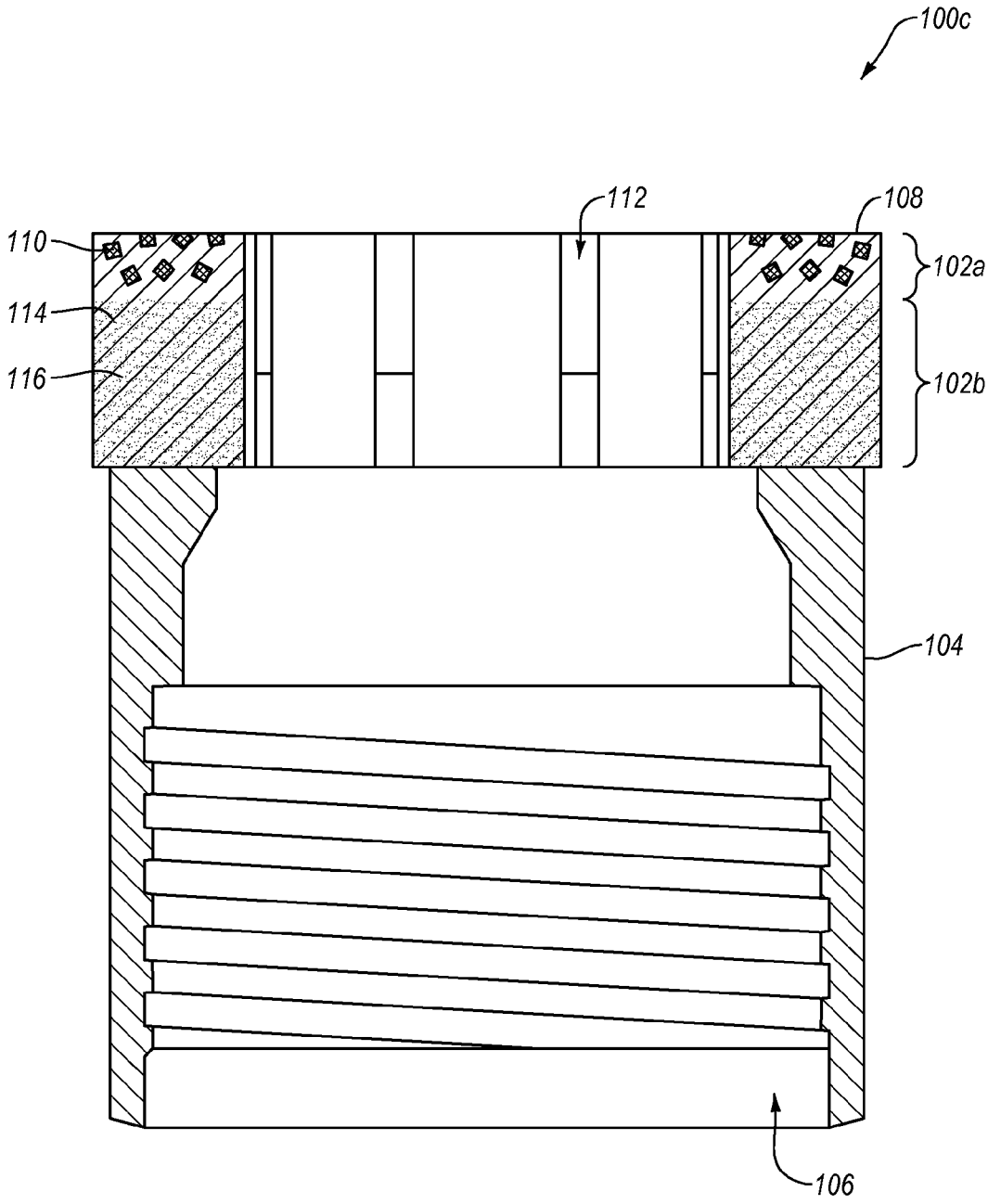
FIG. 5 illustrates a cross-sectional view of an impregnated drill bit including a first portion including a plurality of relatively large abrasive cutting media and a second portion including a plurality of small abrasive particles in accordance with an implementation of the present invention.

As alluded to earlier, the dispersal of the relatively large abrasive cutting media 110 and/or small abrasive cutting media 116 in the impregnated drill bits of the present invention can be customized to the desired formation through which it will be drilling. For example, FIG. 5 illustrates a cross-sectional view of an impregnated drill bit 100*c* with a crown 102 customized for a particular formation. In particular, the portion of the crown 102*a* that is closest to the cutting face 108 of the impregnated drill bit 100*c* contains a plurality of relatively large abrasive cutting media 110. Additionally, the portion of the crown 102*b* that is closest to the shank 104 of the impregnated drill bit 100*c* contains a plurality of small abrasive cutting media 116. Such an impregnated drill bit 100*c* may be used to drill a formation that begins with a soft, abrasive, unconsolidated formation, which gradually shifts to a hard, non-consolidated formation.

In particular, the relatively large abrasive cutting media 110 of the first portion of the crown 102*a* can cut the soft material of the formation allowing the impregnated drill bit 100*c* to penetrate the soft formation relatively quickly. Then the small abrasive cutting media 116 of the second portion of the crown 102*b* can abrade the harder material of the formation allowing the impregnated drill bit 100*c* to penetrate the harder formation relatively quickly.

In alternative implementations, the first portion of the crown 102*a* can include small abrasive cutting media 116, while the second portion of the crown 102*b* includes relatively large abrasive cutting media 110. In yet further implementations, one of the first portion 102*a* and the second portion 102*b* of the crown can include both relatively large abrasive cutting media 110 and small abrasive cutting media 116. In still further implementations, the impregnated drill bit 100*c* can include more than two distinct sections 102*a*, 102*b*. For example, the impregnated drill bit 100*c* can include three, four, five or more sections each tailored to cut efficiently through different types of formations.

One will appreciate that the impregnated drill bits with relatively large abrasive cutting media according to implementations of the present invention can be used with almost any type of drilling system to perform various drilling operations. For example, FIG. 6, and the corresponding text, illustrate or describe one such drilling system with which drilling tools of the present invention can be used. One will appreciate, however, the drilling system shown and described in FIG. 6 is only one example of a system with which drilling tools of the present invention can be used.

Figure 6:
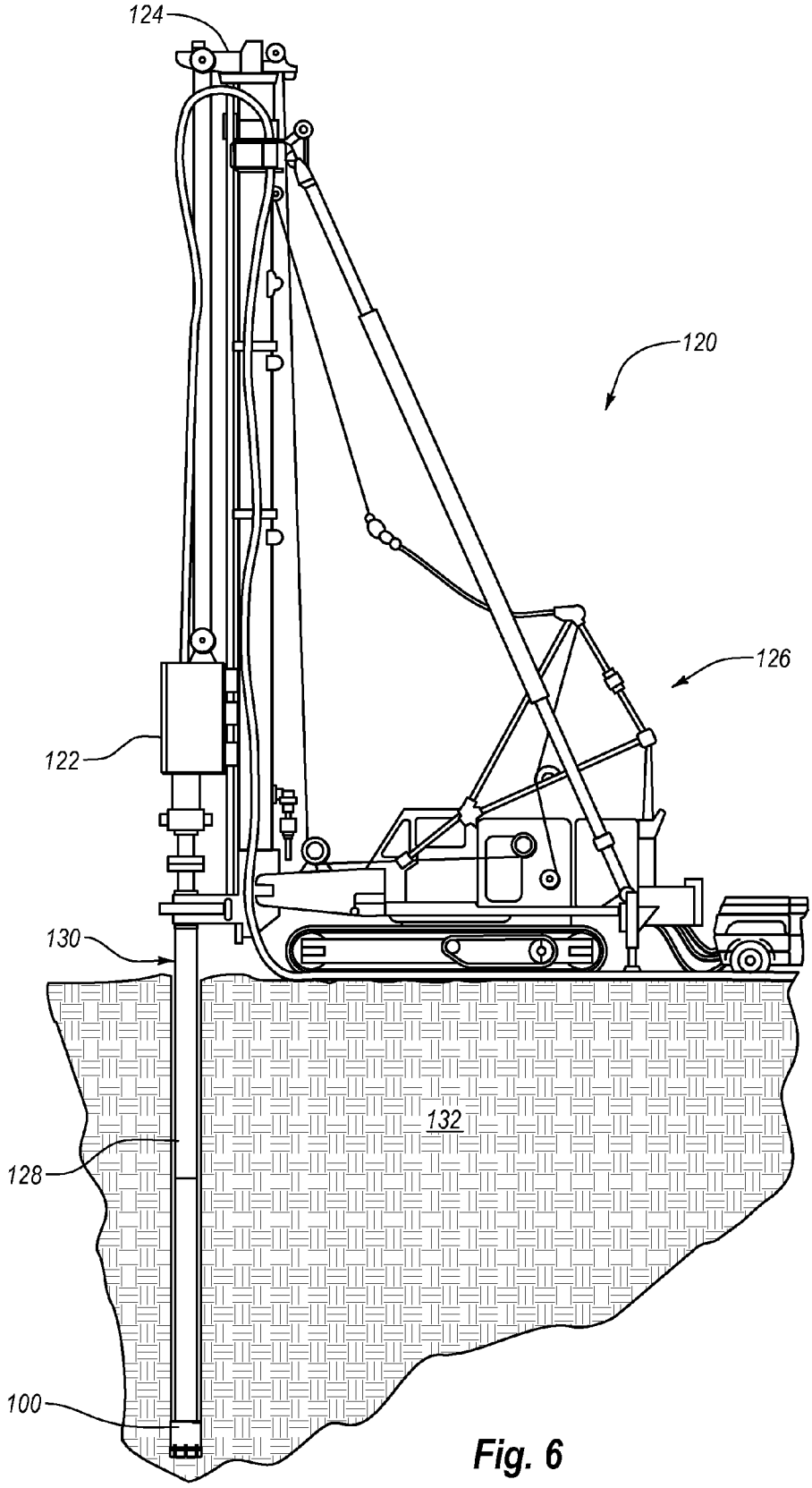
FIG. 6 illustrates a schematic view a drilling system including an impregnated drill bit including a plurality of relatively large abrasive cutting media in accordance with an implementation of the present invention.

For example, FIG. 6 illustrates a drilling system 120 that includes a drill head 122. The drill head 122 can be coupled to a mast 124 that in turn is coupled to a drill rig 1260. The drill head 122 can be configured to have one or more tubular members 128 coupled thereto. Tubular members can include, without limitation, drill rods, casings, reaming shells, and down-the-hole hammers. For ease of reference, the tubular members 128 will be described herein after as drill string components. The drill string component 128 can in turn be coupled to additional drill string components 128 to form a drill or tool string 130. In turn, the drill string 130 can be coupled to an impregnated drill bit 100 including relatively large abrasive cutting media, such as the core-sampling drill bits 100, 100*a*, 100*b*, 100*c* as described hereinabove. As alluded to previously, the impregnated drill bit 100 including relatively large abrasive cutting media can be configured to interface with the material 132, or formation, to be drilled.

In at least one example, the drill head 122 illustrated in FIG. 11 can be configured rotate the drill string 130 during a drilling process. In particular, the drill head 122 can vary the speed at which the drill string 130 rotates. For instance, the rotational rate of the drill head and/or the torque the drill head 122 transmits to the drill string 130 can be selected as desired according to the drilling process.

Furthermore, the drilling system 120 can be configured to apply a generally longitudinal downward force to the drill string 130 to urge the impregnated drill bit 100 including relatively large abrasive cutting media into the formation 132 during a drilling operation. For example, the drilling system 120 can include a chain-drive assembly that is configured to move a sled assembly relative to the mast 124 to apply the generally longitudinal force to the impregnated drill bit 100 including relatively large abrasive cutting media as described above.

As used herein the term "longitudinal" means along the length of the drill string 130. Additionally, as used herein the terms "upper," "top," and "above" and "lower" and "below" refer to longitudinal positions on the drill string 130. The terms "upper," "top," and "above" refer to positions nearer the mast 124 and "lower" and "below" refer to positions nearer the impregnated drill bit 100 including relatively large abrasive cutting media.

Thus, one will appreciate in light of the disclosure herein, that the drilling tools of the present invention can be used for any purpose known in the art. For example, an impregnated drill bit including relatively large abrasive cutting media 100, 100*a*, 100*b*, 100*c* can be attached to the end of the drill string 130, which is in turn connected to a drilling machine or rig 126. As the drill string 130 and therefore impregnated drill bit including relatively large abrasive cutting media 100 are rotated and pushed by the drilling machine 126, the drill bit 100 can grind away the materials in the subterranean formations 132 that are being drilled. The core samples that are drilled away can be withdrawn from the drill string 130. The cutting portion of the drill bit 100 can erode over time because of the grinding action. This process can continue until the cutting portion of a drill bit 100 has been consumed and the drilling string 130 can then be tripped out of the borehole and the drill bit 100 is replaced.

Figure 7:
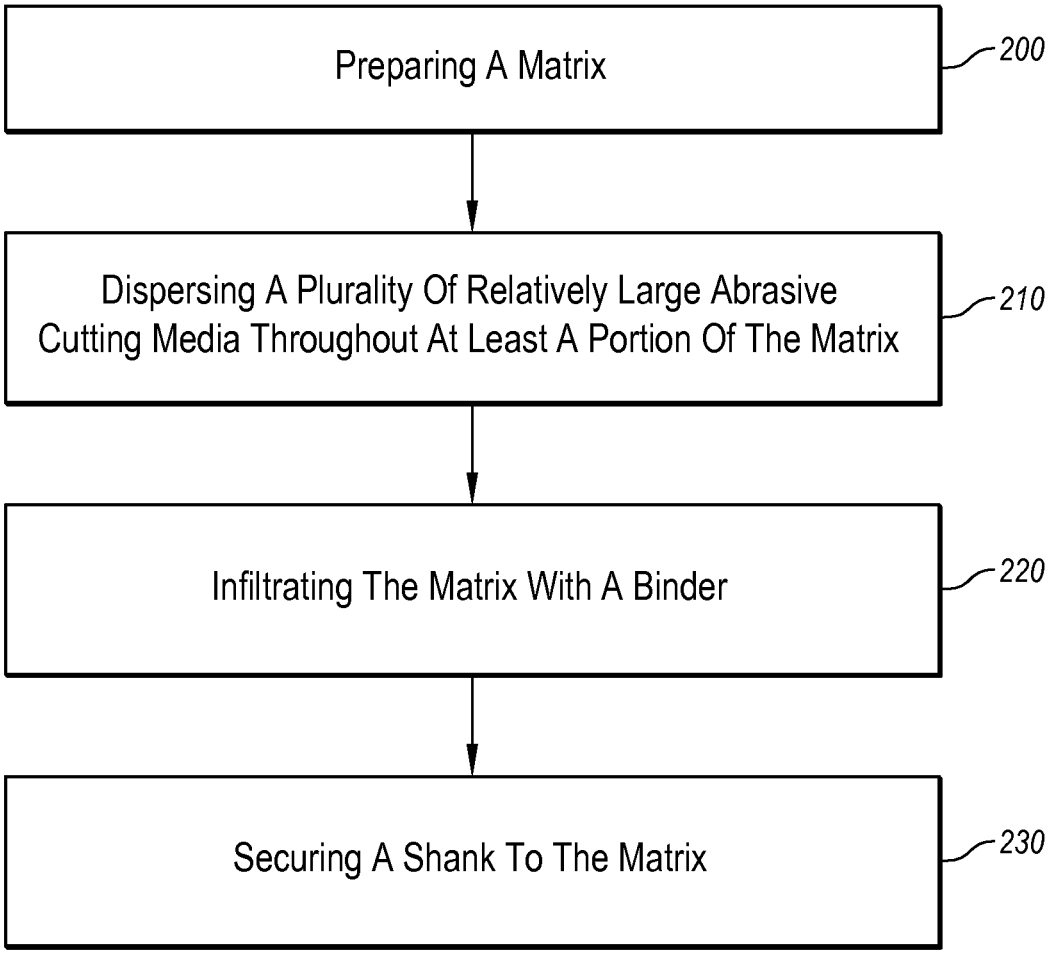
FIG. 7 illustrates a chart of acts and steps in a method of forming an impregnated drill bit including a plurality of relatively large abrasive cutting media in accordance with an implementation of the present invention.

Implementations of the present invention also include methods of forming impregnated drill bits including relatively large abrasive cutting media. The following describes at least one method of forming drilling tools having relatively large abrasive cutting media. Of course, as a preliminary matter, one of ordinary skill in the art will recognize that the methods explained in detail can be modified to install a wide variety of configurations using one or more components of the present invention. For example, FIG. 7 illustrates a flowchart of one exemplary method for producing an impregnated drill bit with relatively large abrasive cutting media using principles of the present invention. The acts of FIG. 7 are described below with reference to the components and diagrams of FIGS. 1 through 6.

As an initial matter, the term "infiltration" or "infiltrating" as used herein involves melting a binder material and causing the molten binder to penetrate into and fill the spaces or pores of a matrix. Upon cooling, the binder can solidify, binding the particles of the matrix together. The term "sintering" as used herein means the removal of at least a portion of the pores between the particles (which can be accompanied by shrinkage) combined with coalescence and bonding between adjacent particles.

For example, FIG. 7 shows that a method of forming an impregnated drill bit can comprise an act 200 of preparing a matrix. Act 200 can include preparing a matrix of hard particulate material. For example, act 200 can comprise preparing a matrix of a powered material, such as for example tungsten carbide. In additional implementations, the matrix can comprise one or more of the previously described hard particulate materials. In some implementations of the present invention, act 200 can include placing the matrix in a mold.

The mold can be formed from a material that is able to withstand the heat to which the matrix will be subjected to during a heating process. In at least one implementation, the mold may be formed from carbon. The mold can be shaped to form a drill bit having desired features. In at least one implementation of the present invention, the mold can correspond to a core drill bit.

In addition, FIG. 7 shows that the method can comprise an act 210 of dispersing a plurality of relatively large abrasive cutting media throughout at least a portion the matrix. For example, act 210 can involve dispersing a first plurality of abrasive cutting media throughout at least a portion of the matrix. In particular, act 210 can include dispersing relatively larger abrasive cutting media that has at least one dimension between about 2.5 millimeters and about 5 millimeters. In some implementations, act 210 can include dispersing relatively large abrasive cutting media that has a volume between about 8 $mm^3$ and about 125 $mm^3$. In one or more implementations, the relatively large abrasive cutting media can comprise polycrystalline diamonds. Additionally, the method can involve dispersing the relatively large abrasive cutting media randomly or in an unorganized arrangement throughout the matrix.

In one or more implementations, the method can additionally include dispersing a plurality of small abrasive cutting media throughout at least a portion the matrix. For example, the method can involve dispersing a second plurality of abrasive cutting media throughout at least a portion of the matrix. In particular, the method can include dispersing abrasive cutting media that has a largest dimension less than about 2 millimeters. In some implementations, the method can include dispersing small abrasive cutting media that has a volume less than about 8 $mm^3$. In one or more implementations, the smaller cutting media can comprise natural or synthetic diamonds. In still further implementations, the smaller cutting media can comprise single diamond crystals. Additionally, the method can involve dispersing the small abrasive cutting media randomly or in an unorganized arrangement throughout the matrix.

In one or more further implementations, the method can further include dispersing a plurality of fibers throughout at least a portion of the matrix. In particular, the method can include dispersing carbon fibers randomly or in an unorganized arrangement throughout the matrix.

FIG. 7 also shows that the method can comprise an act 220 of infiltrating the matrix with a binder. Act 220 can involve heating the binder to a molten state and infiltrating the matrix with the molten binder. For example, in some implementations the binder can be placed proximate the matrix 114 and the matrix 114 and the binder can be heated to a temperature sufficient to bring the binder to a molten state. At which point the molten binder can infiltrate the matrix 114. In one or more implementations, act 220 can include heating the matrix 114 and the binder to a temperature of at least 787° F.

The binder can comprise copper, zinc, silver, molybdenum, nickel, cobalt, tin, iron, aluminum, silicon, manganese, or mixtures and alloys thereof. The binder can cool thereby bonding to the matrix and abrasive cutting media, thereby binding the matrix and abrasive cutting media together. According to some implementations of the present invention, the time and/or temperature of the infiltration process can be increased to allow the binder to fill-up a greater number and greater amount of the pores of the matrix. This can both reduce the shrinkage during sintering, and increase the strength of the resulting drilling tool.

Additionally, FIG. 7 illustrates that the method can comprise an act 230 of securing a shank 104 to the matrix 114. For example, act 230 can include placing a shank 104 in contact with the matrix 114. A backing layer 103 of additional matrix, binder material, and/or flux may then be added and placed in contact with the matrix 114 as well as the shank 104 to complete initial preparation of a green drill bit. Once the green drill bit has been formed, it can be placed in a furnace to thereby consolidate the drill bit. Thereafter, the drill bit can be finished through machine processes as desired.

Before, after, or in tandem with the infiltration of the matrix 114, one or more methods of the present invention can include sintering the matrix 14 to a desired density. As sintering involves densification and removal of porosity within a structure, the structure being sintered can shrink during the sintering process. A structure can experience linear shrinkage of between 1% and 40% during sintering. As a result, it may be desirable to consider and account for dimensional shrinkage when designing tooling (molds, dies, etc.) or machining features in structures that are less than fully sintered.

Accordingly, the schematics and methods described herein provide a number of unique products that can be effective for drilling through both soft and hard formations. Additionally, such products can have an increased drilling penetration rate due to the relatively large abrasive cutting media. Furthermore, as the relatively large abrasive cutting media can be dispersed throughout the crown, new relatively large abrasive cutting media can be continually exposed during the drilling life of the impregnated drill bit.

The present invention can thus be embodied in other specific forms without departing from its spirit or essential characteristics. For example, the impregnated drill bits of one or more implementations of the present invention can include one or more enclosed fluid slots, such as the enclosed fluid slots described in U.S. patent application Ser. No. 11/610,680, filed Dec. 14, 2006, entitled "Core Drill Bit with Extended Crown Longitudinal dimension," now U.S. Pat. No. 7,628,228, the content of which is hereby incorporated herein by reference in its entirety. Still further, the impregnated drill bits of one or more implementations of the present invention can include one or more tapered waterways, such as the tapered waterways described in U.S. patent application Ser. No. 12/638,229, filed Dec. 15, 2009, entitled "Drill Bits With Axially-Tapered Waterways," the content of which is hereby incorporated herein by reference in its entirety. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. An impregnated drill bit, comprising:

a shank having a first end and an opposing second end, said first end being adapted to be secured to a drill string component;

a crown extending from said second end of said shank, said crown including a matrix of hard particulate material, a cutting face, and a crown body between said cutting face and said shank;

a first plurality of abrasive cutting media having at least one dimension between about 2.0 millimeters and about 5 millimeters, said first plurality of abrasive cutting media being positioned in an unorganized arrangement throughout a first portion of said crown body adjacent said cutting face; and a second plurality of abrasive cutting media having a largest dimension less than about 2.0 millimeters, said second plurality of abrasive cutting media being dispersed throughout a second portion of said crown body between said first portion of said crown body and said shank.

2. The impregnated drill bit as recited in claim 1, wherein said first plurality of abrasive cutting media comprise polycrystalline diamonds.

3. The impregnated drill bit as recited in claim 2, wherein said first plurality of abrasive cutting media comprise thermally stable diamonds.

4. The impregnated drill bit as recited in claim 1, wherein said first plurality of abrasive cutting media comprise aluminum oxide.

5. The impregnated drill bit as recited in claim 1, wherein said second plurality of abrasive cutting media are dispersed in an unorganized arrangement throughout the second portion of said crown body.

6. The impregnated drill bit as recited in claim 1, wherein the abrasive cutting media of said second plurality of abrasive cutting media comprise natural diamond.

7. The impregnated drill bit as recited in claim 1, wherein said largest diameter of said second plurality of abrasive cutting media is between about 0.01 millimeters and about 1.0 millimeters.

8. The impregnated drill bit as recited in claim 1, wherein said first plurality of abrasive cutting media comprise abrasive cutting media having a cubic shape.

9. The impregnated drill bit as recited in claim 1, wherein said crown comprises an annular shape including a longitudinal axis there through, an inner surface, and an outer surface, said crown defining an interior space about the longitudinal axis for receiving a core sample.

10. The impregnated drill bit as recited in claim 1, further comprising a plurality of fibers dispersed in an unorganized arrangement throughout at least a portion of said crown body.

11. The impregnated drill bit as recited in claim 1, wherein the abrasive cutting media of said first plurality of abrasive cutting media extend out of said cutting face.

12. The impregnated drill bit as recited in claim 1, further comprising one or more coatings on said first plurality of abrasive cutting media.

13. An impregnated drill bit, comprising:

a shank;

a cutting portion secured to said shank, said cutting portion including a matrix of hard particulate material and a cutting face;

a first plurality of abrasive cutting media dispersed throughout a first portion of said cutting portion adjacent said cutting face, wherein at least one abrasive cutting media of said first plurality of abrasive cutting media has a first volume, and wherein said first volume of said first plurality of abrasive cutting media is between about 8 $mm^3$ and about 125 $mm^3$; and a second plurality of abrasive cutting media dispersed throughout a second portion of said cutting portion between said first portion of said cutting portion and said shank, wherein at least one abrasive cutting media of said second plurality of abrasive cutting media has a second volume, and wherein said second volume is less than about 0.75 times said first volume.

14. The impregnated drill bit as recited in claim 13, wherein said second volume of said second plurality of abrasive cutting media is between about 0.001 $mm^3$ and about 8 $mm^3$.

15. The impregnated drill bit as recited in claim 13, wherein said first plurality of abrasive cutting media comprise polycrystalline diamonds.

16. The impregnated drill bit as recited in claim 15, wherein said first plurality of abrasive cutting media comprise thermally stable diamonds.

17. The impregnated drill bit as recited in claim 13, wherein said first plurality of abrasive cutting media comprise aluminum oxide.

18. The impregnated drill bit as recited in claim 13, wherein said second plurality of abrasive cutting media comprise single diamond crystals.

19. The impregnated drill bit as recited in claim 13, further comprising a plurality of fibers dispersed throughout at least a portion of said cutting portion.

20. The impregnated drill bit as recited in claim 13, wherein said first plurality of abrasive cutting media are randomly dispersed throughout said first portion of said cutting portion, and wherein said second plurality of abrasive cutting media are randomly dispersed throughout said second portion of said cutting portion.

21. The impregnated drill bit as recited in claim 13, wherein said cutting portion comprises an annular crown including a longitudinal axis there through, an inner surface, and an outer surface, said annular crown defining an interior space about the longitudinal axis for receiving a core sample.

22. The impregnated drill bit as recited in claim 13, wherein said hard particulate material comprises tungsten carbide.

23. The impregnated rill bit as recited in claim 13, further comprising one or more coatings on said first plurality of abrasive cutting media.

24. A drilling system, comprising:

a drill rig;

a drill string adapted to be secured to and rotated by said drill rig; and an impregnated drill bit adapted to be secured to said drill string, said impregnated drill bit comprising a shank and a crown, said crown including cutting face, a first plurality of diamonds having at least one dimension between about 2.0 millimeters and about 5 millimeters, and a second plurality of diamonds having a largest dimension less than about 2.0 millimeters, said first plurality of diamonds being dispersed in an unorganized arrangement throughout a first portion of said crown adjacent said cutting face of said crown, said second plurality of diamonds being dispersed in an unorganized arrangement throughout a second portion of said crown between said first portion of said crown and said shank.

25. The drilling system as recited in claim 24, wherein said first plurality of diamonds comprise thermally stable diamonds.

26. The drilling system as recited in claim 24, further comprising a plurality of fibers dispersed throughout at least a portion of said crown.

27. The drilling system as recited in claim 24, wherein said crown of said impregnated drill bit comprises an annular shape including a longitudinal axis there through, an inner surface, and an outer surface, said crown defining an interior space about the longitudinal axis for receiving a core sample.

28. The drilling system as recited in claim 24, further comprising one or more coatings on said first plurality of abrasive cutting media of said impregnated drill bit.

29. A method of drilling, comprising:

securing an impregnated drill bit to a drill string, wherein a crown of said impregnated drill bit has a cutting face and comprises a hard particulate material, a binder material, a first plurality of abrasive cutting media, and a second plurality of abrasive cutting media;

wherein abrasive cutting media of said first plurality of abrasive cutting media each have a volume between about 8 $mm^3$ and about 125 $mm^3$, wherein said first plurality of abrasive cutting media are dispersed in an unorganized arrangement throughout a first portion of said crown adjacent said cutting face of said crown, and wherein said second plurality of abrasive cutting media are dispersed in an unorganized arrangement throughout a second portion of said crown between said first portion of said crown and a shank of said impregnated drill bit; and rotating said drill string to cause said impregnated drill bit to penetrate an earthen formation.

30. The method as recited in claim 29, further comprising securing said drill string to a drill rig and using said drill rig to rotate said drill string.

31. The method as recited in claim 29, further comprising retrieving a core sample using said impregnated drill bit.

32. The method as recited in claim 29, wherein said first plurality of abrasive cutting media and said second plurality of abrasive cutting media comprise diamonds.

33. The impregnated drill bit as recited in claim 1, wherein said first plurality of abrasive cutting media have at least one dimension between about 2.5 millimeters and about 5 millimeters.

* * * * *